United States Patent [19]

Sakiyama et al.

[11] Patent Number: 5,035,754

[45] Date of Patent: Jul. 30, 1991

[54] HEAT TREATING METHOD FOR HIGH STRENGTH ALUMINUM ALLOY

[75] Inventors: Tetsuo Sakiyama; Seishi Tsuyama; Kuninori Minakawa, all of Kawasaki, Japan

[73] Assignee: NKK Corporation, Tokyo, Japan

[21] Appl. No.: 504,255

[22] Filed: Apr. 4, 1990

[30] Foreign Application Priority Data

Apr. 14, 1989 [JP] Japan ..... 1-94794

[51] Int. Cl.[5] ..... C21D 1/00; C22C 21/06

[52] U.S. Cl. ..... 148/159; 148/11.5 A; 148/12.7 A; 148/417

[58] Field of Search ..... 148/11.5 A, 12.7 A, 148/159, 417, 439

[56] References Cited

U.S. PATENT DOCUMENTS

| | | | |
|---|---|---|---|
| 2,248,185 | 7/1941 | Nock | 148/159 |
| 3,133,839 | 5/1964 | Thomas | 148/12.7 A |
| 3,198,676 | 8/1965 | Sprowls | 148/159 |
| 3,836,405 | 9/1974 | Staley et al. | 148/12.7 A |

*Primary Examiner*—R. Dean
*Assistant Examiner*—Robert R. Koehler
*Attorney, Agent, or Firm*—Frishauf, Holtz, Goodman & Woodward

[57] ABSTRACT

A heat treating method for a high strength aluminum alloy comprising the steps of: solution heat treating of an aluminum alloy consisting essentially of about 3 to 9 wt. % Zn, 1 to 6 wt. % Mg, 1 to 3 wt. % Cu, at least one element selected from the group consisting of 0.1 to 0.5 wt. % Cr, 0.1 to 0.5 wt. % Zr, 0.2 to 1.0 wt. % Mn, and the balance being Al, heating of the solution heat treated alloy to a temperature of a lower temperature zone of from 100° to 140° C. and optionally maintaining the alloy at a temperature within the lower temperature zone for a duration of time, reheating of the alloy to a temperature of an upper temperature zone of from 160° to 200° C. and optionally maintaining the alloy at a temperature within the upper temperature zone for a second duration of time, cooling of the alloy to a temperature of the lower temperature zone, and repeating the steps (2), (3), and (4) at least twice.

19 Claims, 2 Drawing Sheets

HEAT TREATING METHOD FOR HIGH STRENGTH ALUMINUM ALLOY

BACKGROUND OF THE INVENTION

1. Field of the Invention

The invention relates to the field of metallurgy and particularly to the field of Al-Zn-Mg-Cu alloy having high strength and high corrosion resistance.

2. Description of the Prior Art

Aluminum alloys are widely used in structures wherein low weight and high strength properties are required as those of airplanes.

Among them the 7000 series Al-Zn-Mg-Cu aluminium alloys represented by 7075 and 7050 aluminium alloys of Japanese Industrial Standard (JIS) are widely utilized. These alloys obtain high strength by fine precipitates resulting from solution heat treatments and aging treatments. Generally speaking in the aging treatment, alloys are heat-treated under isothermal conditions for from several hours to a duration of a time less than 100 hours in the temperature range of from 100° to 200° C. at single or dual temperature level. For example, in the recommended aging condition of JIS-W-1103, the temperature range is from 116° to 127° C. and the aging time is 24 hours for the 7075 alloys, whereas for the 7075 alloys with T 73 treatment, the temperature range is from 102° to 113° C. and the aging time is from 6 to 8 hours for the first step treatment and from 102° to 113° C., and from 6 to 8 hours for the second step treatment. In the aging treatment, the temperatures should be kept constant in the recomended range for the duration of a comparatively long time, which leads to the prescribed material properties of the alloys.

In the 7000 series aluminium alloys, the high strength property is obtained by the formation of the fine precipitates of the aforementioned solution treatment and the aging treatment.

However the dimension, shape, and distribution of the precipitates vary with the aging condition. For example, in the case to 7075T6 alloy, the tensile strength of 58 kgf/mm$^2$ is obtained, whereas susceptibility of the stress corrosion cracking is enhanced. In the case of the 7075 alloys forging, the threshold stress in the ST direction wherein the stress corrosion cracking does not occur in the material, is 6 kgf/mm$^2$ for 7075T6, T6, and 31 kgf/mm$^2$ for 7075T73 condition. The resistance to the stress corrosion cracking of the material is enhanced at the sacrifice of the strength of alloys. Accordingly it is difficult to have both the corrosion resistance and the high strength property of material in the 7000 series aluminium alloys. The cause lies in the state of the precipitates which is determined by the aging treatment. When the aging is carried out under a comparatively low temperature such as 120° C., a very fine precipitate of the size of 5 nanometers is formed, and high strength is obtained. When the aging is carried out under a comparatively high temperature such as 170° C. as in the case of 7075 T 73, the size of the precipitate grows to from 10 to 20 nanometers, and the strength is lowered, but the corrosion resistance such as the susceptibily to stress corrosion cracking is lowered.

As mentioned above, to produce aluminium alloys having both the corrosion resistance and the high strength property, it is necessary to change the state of the precipitates. However, it is difficult to change the state of the precipitate in the prior art.

SUMMARY OF THE INVENTION

It is an object of the invention to provide a heat treating method for a high strength aluminium alloy.

According to the invention a heat treating method for a high strength aluminium alloy is provided comprising the steps of;

(1) solution heat treating of an aluminium alloy consisting essentially of about 3 to 9 wt.% Zn, 1 to 6 wt.% Mg, 1 to 3 wt.% Cu, at least one element selected from the group of 0.1 to 0.5 wt.% Cr, 0.1 to 0.5 wt.% Zr, 0.2 to 1.0 wt.% Mn, and the balance being Al, (2) heating of the alloy to a temperature of a lower temperature zone of from 100° to 140° C. for a duration of time, (3) reheating of an alloy to a temperature of the upper temperature zone of from 160° to 200° C. for a second duration of time, (4) cooling of the alloy to a temperature of the lower temperature zone, and (5) repeating the steps (2), (3), and (4) at least twice.

The duration of time in the lower temperature zone and/or that in the upper temperature zone may be null. The temperature of the lower temperature zone may be more preferably from 105° to 125° C., and the temperature of the upper temperature zone may be from 160° to 180° C.

DESCRIPTION OF THE PREFERRED EMBODIMENTS

Figure 1:
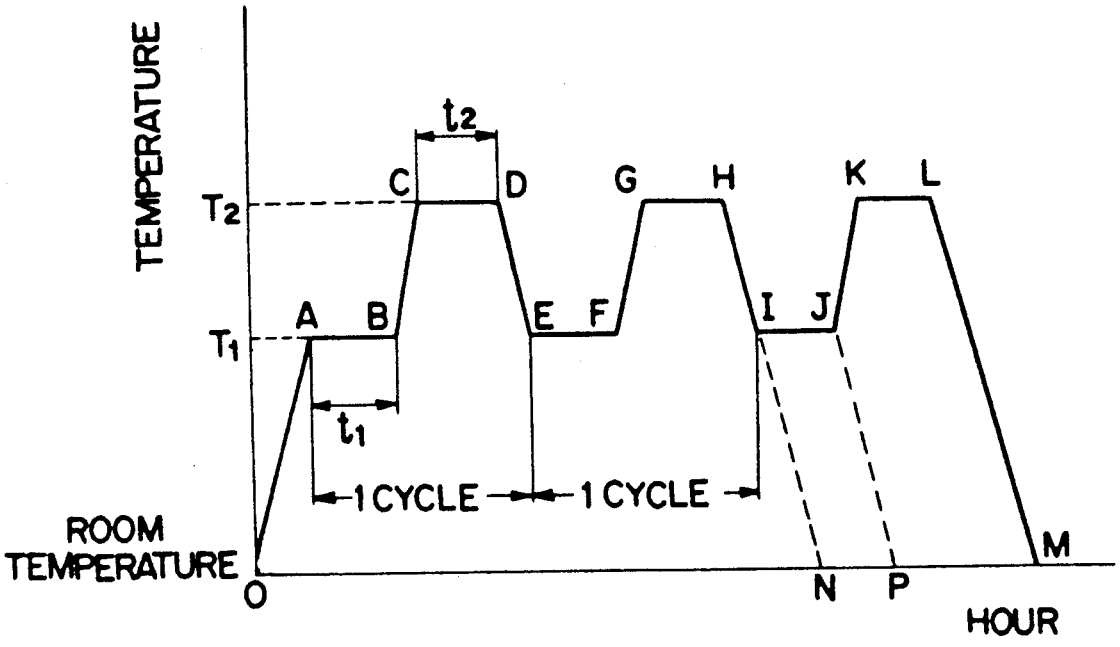
FIGS. 1, 2(A), 2(B), and 2(C) are graphs showing the patterns of the heat treatments of the invention.

As mentioned before, the resistance to the stress corrosion cracking of the material was enhanced at the sacrifice of the strength of alloys. To compromise between the two properties aging treatment is an effective means. To obtain aluminium alloys having both the corrosion resistance and the high strength, the following conditions of chemical composition and heat treatment are required:

The chemical composition is; Zn being from 3 to 9 wt. %, Mg being from 1 to 6 wt. %, Cu being from 1 to 3 wt. %, at least one element selected from the group of; Cr being from 0.1 to 0.5 wt. %, Zr being from 0.1 to 0.5 wt. %, and Mn being from 0.2 to 1.0 wt. %, and the balance aluminium.

The heat treatment condition is;

(1) the above mentioned material is solution heat treated, (2) the material is heated to the lower temperature zone of from 100° to 140° C. for a duration of time, (3) the material is reheated to the upper temperature zone of from 160° to 200° C. for a duration of time, (4) the material is cooled down to the temperature range specified in (2), and (5) the steps (2), (3), and (4) are repeated at least twice.

The reason of the specification of the above conditions is explained as follows:

1. Zn is necessary for the enhancement of the strength.

However when the Zn content is below 3 wt. %, sufficient practical strength cannot be obtained. When the Zn content exceeds 9 wt. %, the hot workability is lowered.

Accordingly, the Zn content is determined to be from 3 to 9 wt. %.

2. Mg is necessary for the enhancement of the strength.

However when the Mg content is below 1 wt. %, sufficient practical strength cannot be obtained. When the Mg content exceeds 6 wt. %, the hot workability and the corrosion resistance are lowered. Accordingly, the Mg content is determined to be from 1 to 6 wt. %.

3. Cu is necessary for the enhancement of the strength and the corrosion resistance. However the effect is saturated when the Cu content exceeds 3 wt. %. When the Cu content is below 1 wt. %, enough strength cannot be obtained. Accordingly, the Cu content is determined to be from 1 to 3 wt. %.

4. Cr, Zr, and Mn retard the recrystalization and promote the resistance to the stress corrosion cracking (hereinafter SCC). At least one of these element can be added to the alloy. However when the Cr content is below 0.1 wt. %, Zr, below 0.1 wt. %, and Mn, below 0.2 wt. %, the above mentioned effect cannot be obtained. When the Cr content exceeds 0.5 wt. %, Zr content, 0.5 wt. %, and Mn, 1.0 wt. %, the effect is saturated.

Accordingly the Cr content is determined to be from 0.1 to 0.5 wt. %, Zr, from 0.1 to 0.5 wt. %, and Mn, from 0.2 to 1.0 wt. %

5. The reason for the heat treatment conditions is explained as follows;

FIGS. 1, 2(A), 2(B), and 2(C) are graphs showing the patterns of the heat treatments of the inventions.

As shown in FIG. 1, the aluminium alloy is solution heat treated and is heated from room temperature, denoted as O, to the temperature, denoted as A, of the lower temperature zone and kept isothermally at the temperature for a duration of time $t_1$, denoted as AB.

The alloy is reheated to the temperature, denoted as C, of the upper temperature zone and kept isothermally at the temperature for a duration of time $t_2$, denoted as CD, and cooled down to the temperature, denoted as E, of the lower temperature zone. This is the cycle of the aging treatment and the cycle is repeated at least twice as shown by the points E, F, G, H, I, J, K, L, and M. The point M denotes room temperature.

5.1. When the temperature of the lower temperature zone is lower than 100° C., $t_1$ becomes large to obtain a sufficient strength which is uneconomical, since the rate of growth of the precipitate is small at the temperature. When the temperature of the lower tempeature zone is higher than 140° C., the sufficient strength cannot be obtained. Accordingly the temperature of the lower temperature zone is determined to be from 100° to 140° C., and more preferably from 105° to 125° C.

5.2. When the temperature of the upper temperature zone is lower than 160° C., the precipitate effective to the corrosion resistance cannot be obtained.

When the temperature of the upper tempeature zone is higher than 200° C., the sufficient strength cannot be obtained, since a rapid growth of the precipitate occurs. Accordingly the temperature of the upper temperature zone is determined to be from 160° to 200° C., and more preferably from 160° to 180° C.

5.3. When the number of the cycles of the aging treatment is more than two, the strength and the corrosion resistance can be obtained, whereas this cannot be obtained when the number of the cycles is one. The upper limit of the number of the cycles should be determined according to the chemical composition of the alloy and the dimension of the heat treated manufacture, since an excessive number of the cycles leads to the decrease of a strength in spite of an increase of the corrosion resistance. 6. When the number of the cycles is more than two, the alloy can be cooled down from the temperature of the upper temperature zone down to the room temperature, denoted as N, or can be cooled down from the temperature of the lower temperature zone down to the room temperature, denoted as P, after a duration of time $t_2$, denoted as IJ as shown in FIG. 1.

Figure 2A:
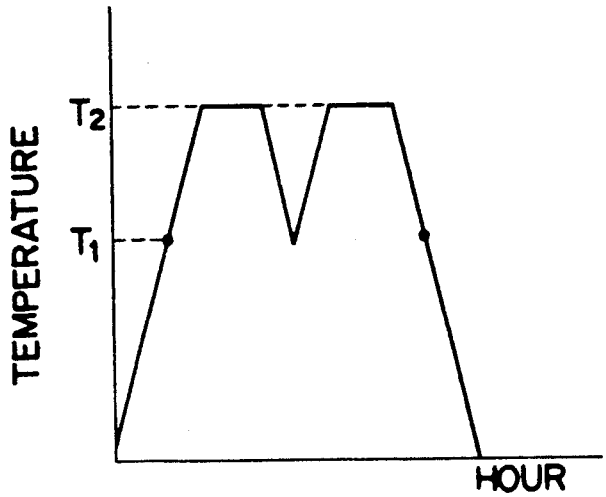
Figure 2B:
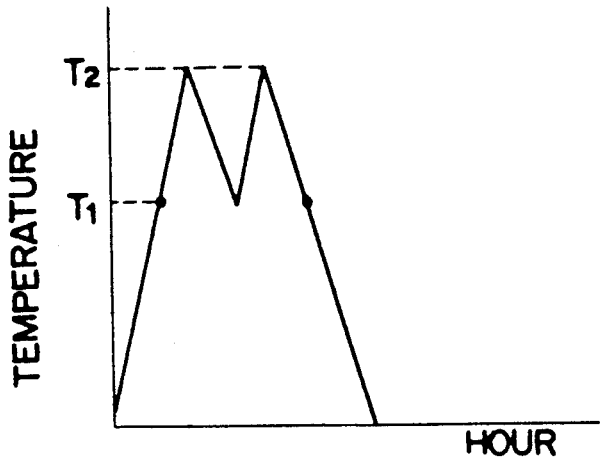
Figure 2C:
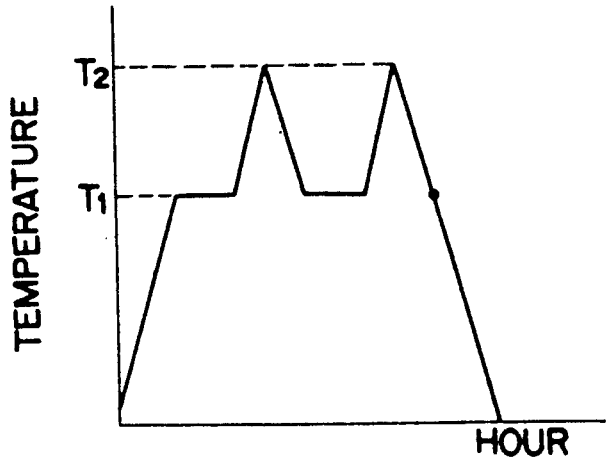

7. As for the duration time $t_1$ and $t_2$, $t_1$ can be zero as shown in FIG. 2(A), $t_2$ can be zero as shown in FIG. 2(C), and $t_1$ and $t_2$ can be zero as shown in FIG. 2(B) with no influence on the properties of the alloy.

8. The temperatures except an ambient one can be different among the heat cycles when the temperatures are in the range prescribed above with no influence on the properties of the alloy.

9. The rates of heating and cooling between the zones can be chosen with no influence on the properties of the alloy.

EXAMPLES

The invention is explained by examples described below:

The samples for tests are prepared as follows:

The samples are of a 7050 series Al-6.3Zn-2.5Mg-2.5Cu-0.12Zr alloy and a 7075 series Al-5.6Zn-2.3Mg-1.6Cu-0.1Cr-0.2Mn alloy. The samples are hot forged or hot rolled into a plate with a thickness of 13 mm, solution heat treated at 480° C., and aging treated as described below:

EXAMPLE 1

The aging treatment is carried out according to the patterns shown in FIGS. 1, 2(A), 2(B), and 2(C), and the temperatures, the duration of time, and the number of cycles are varied according to Table 1*a*. As for Table 1*a*, $T_1$ and $T_2$ denote the aging temperatures of the lower temperature zone and the upper temperature zone, respectively, and, $t_1$ and $t_2$ denote the duration of time at the aging temperature $T_1$, $T_2$ respectively. The heating and cooling rates are 0.5° C./min. Two kinds of aging, namely, the peak aging and the over aging are carried out by conventional methods of aging for the purpose of comparison.

Various tests are carried out as for the samples treated by the invented method and the conventional method. The tensile test is carried out to obtain the strength and the elongation.

The fracture toughness test is carried out for a part of the samples.

The exfoliation corrosion test prescribed by ASTM G 34 is carried out for all the samples. The stress corrosion cracking (SCC) test prescribed by JIS-H-8711 is carried out for a part of the samples. In the SCC test, the samples are stressed by a three point bending method and under the applied stress, the immersion of the samples into 3.5% NaCl aqueous solution and the drying thereof in air, is repeated for twenty days. As the result of the test the maximum stress wherein the crack is not generated, is defined as the threshold stress value of the SCC.

Tables 1*a* and 1*b* report the aging treatment conditions and the test results. The evaluating index of the exfoliation corrosion test, Exco rating, is P, EA, EB, EC, ED in the order of the superiority of the evaluation, wherein the Exco rating of P and EA are allowable values in the practical use of the alloy.

As shown in Table 1*b*, the samples of the invention have the tensile strength of from 57 to 62 kgf/mm$^2$ and the value of the Exco rating is P or EA and the threshold stress value of the SCC test is more than 50 kgf/mm$^2$ which is a high value. In the case of Nos. 12 and 13 of the peak aging, the same level of strength with those of the invented ones is obtained, but the corrosion resistance is inferior to those of the invented ones. In the case of Nos. 14 and 15 of the overaging good corrosion resistance is obtained, but the strength is lower by from 3 to 8 kgf/mm$^2$ compared to those of the invented ones.

As for the fracture toughness test, the test value of the invented ones is superior to or equal to those of the conventional ones. This superiority is also recognized in the 7050 series alloy, which proves the effectiveness of the invention.

As shown in Table 1, the patterns of the aging treatment are triangular in Nos. 1, 2, 7, and 8, and trapezoidal in Nos. 3 to 6 and 9 to 11.

The test results reveal that essentially no difference is found between those of the two patterns.

TABLE 1a

| No. | Kind of Alloy | Aging Treatment Pattern $T_1$ (°C.) | $t_1$ (min.) | $T_2$ (°C.) | $t_2$ (min.) | No. of Cycles |
|---|---|---|---|---|---|---|
| 1 | 7050 | 120 | 0 | 170 | 0 | 5 |
| 2 | 7050 | 110 | 0 | 180 | 0 | 5 |
| 3 | 7050 | 120 | 100 | 170 | 20 | 3 |
| 4 | 7050 | 120 | 100 | 170 | 20 | 8 |
| 5 | 7050 | 120 | 60 | 170 | 60 | 25 |
| 6 | 7050 | 130 | 90 | 190 | 30 | 5 |
| 7 | 7075 | 120 | 0 | 170 | 0 | 5 |
| 8 | 7075 | 110 | 0 | 180 | 0 | 5 |
| 9 | 7075 | 120 | 100 | 170 | 20 | 3 |
| 10 | 7075 | 120 | 100 | 170 | 20 | 8 |
| 11 | 7075 | 120 | 60 | 170 | 60 | 5 |
| 12 | 7050 | | 120° C. × 24 h | | | — |
| 13 | 7075 | | | | | — |
| 14 | 7050 | | 170° C. × 6 h | | | — |
| 15 | 7075 | | | | | — |

TABLE 1b

| No. | 0.2% PS (kgf/mm$^2$) | TS (kgf/mm$^2$) | E λ (%) | $K_{IC}$ (kgf/mm$^{3/2}$) | Exco Rating | Threshold Stress SCC | Remarks |
|---|---|---|---|---|---|---|---|
| 1 | 58.8 | 61.9 | 13.6 | 95.3 | EA | 53.0 | Invention |
| 2 | 56.0 | 60.2 | 12.8 | — | EA | 52.0 | Examples |
| 3 | 58.0 | 61.8 | 14.0 | — | EA | — | |
| 4 | 54.7 | 57.5 | 14.6 | — | P | — | |
| 5 | 53.6 | 55.5 | 16.0 | — | P | — | |
| 6 | 55.8 | 58.7 | 14.0 | — | P | — | |
| 7 | 49.7 | 54.9 | 13.2 | 97.6 | EA | — | |
| 8 | 50.1 | 54.0 | 14.0 | — | EA | — | |
| 9 | 53.9 | 57.3 | 12.5 | — | EA | — | |
| 10 | 50.0 | 52.6 | 16.8 | — | P | — | |
| 11 | 52.1 | 55.8 | 13.1 | — | EA | — | |
| 12 | 54.1 | 59.0 | 16.4 | 88.9 | EC | 39.5 | Conventional |
| 13 | 52.0 | 57.3 | 15.2 | 92.7 | ED | — | Examples |
| 14 | 49.0 | 54.1 | 16.8 | 97.5 | P | 45.0 | Conventional |
| 15 | 44.8 | 50.2 | 14.5 | 100.3 | EA | — | Examples |

EXAMPLE 2

Tables 2(A) and 2(B) report the aging treatment condition, and the test results on the 7050 alloy wherein $T_1$ and $T_2$ are varied and the number of the cycle is set to be 5. When $T_1$ is low and out of the scope of the invention such as in Nos. 4 and 5, the strength is comparable but the corrosion resistance is inferior to those of the invented ones. When $T_1$ is high and out of the scope of the invention such as in No. 6, the corrosion resistance is comparable but the strength is inferior to those of the invented ones. When $T_2$ is low and out of the scope of the invention such as in No. 9, the corrosion resistance is inferior to those of the invented ones. When $T_2$ is high and out of the scope of the invention such as in Nos. 10 and 11, the strength is inferior to those of the invented ones.

TABLE 2a

| No. | Kind of Alloy | Aging Treatment Pattern $T_1$ (°C.) | $t_1$ (min.) | $T_2$ (°C.) | $t_2$ (min.) | No. of Cycles |
|---|---|---|---|---|---|---|
| 1 | 7050 | 120 | 0 | 170 | 0 | 5 |
| 2 | 7050 | 110 | 0 | 170 | 0 | 5 |
| 3 | 7050 | 135 | 0 | 170 | 0 | 5 |
| 4 | 7050 | 75 | 0 | 170 | 0 | 5 |
| 5 | 7050 | 90 | 0 | 170 | 0 | 5 |
| 6 | 7050 | 150 | 0 | 170 | 0 | 5 |
| 7 | 7050 | 110 | 0 | 180 | 0 | 5 |
| 8 | 7050 | 110 | 0 | 195 | 0 | 5 |
| 9 | 7050 | 110 | 0 | 150 | 0 | 5 |
| 10 | 7050 | 110 | 0 | 210 | 0 | 5 |
| 11 | 7050 | 110 | 0 | 220 | 0 | 5 |

TABLE 2b

| No. | 0.2% PS (kgf/mm$^2$) | TS (kgf/mm$^2$) | E λ (%) | Exco Rating | Remarks |
|---|---|---|---|---|---|
| 1 | 58.8 | 61.9 | 13.6 | EA | Invention |
| 2 | 57.5 | 61.0 | 13.0 | EA | Examples |
| 3 | 55.9 | 59.8 | 16.1 | P | |
| 4 | 52.6 | 59.1 | 12.5 | ED | Comparison |
| 5 | 54.8 | 60.0 | 13.4 | ED | Examples |
| 6 | 47.5 | 52.1 | 14.0 | P | |
| 7 | 56.8 | 62.1 | 13.8 | EA | Invention |
| 8 | 56.0 | 61.5 | 14.1 | P | Examples |
| 9 | 59.5 | 63.4 | 11.5 | ED | Comparison |
| 10 | 45.0 | 50.5 | 15.8 | P | Examples |
| 11 | 42.6 | 49.1 | 17.0 | P | |

EXAMPLE 3

Table 3a and 3b report the aging condition and the test results on the 7050 alloy wherein $T_1$ is fixed to 120° C. and $T_2$, 170° C., and the number of the cycle is varied.

When the number of the cycles is one such as in Nos. 4 and 5, the strength is sufficient but the corrosion resistance is deteriorated.

Even when the number of the cycles is at least two such as in No. 3, wherein the test is interrupted during the cycle, the corrosion resistance is not inferior to those of Nos. 1 and 2.

EXAMPLE 4

Tables 4*a*, 4*b* and 4*c* report the aging treatment condition and the test results on the 7050 alloy wherein $T_1$ and $T_2$ is varied, cycle by cycle, and the number of the cycle is 5. As far as $T_1$ and $T_2$ stays in the temperature zone in the scope of the invention, both high strength and corrosion resistance are obtained. Even when the pattern of the cycles is a combination of triangle and trapezoid as in the case of Nos. 2 and 3, high strength and corrosion resistance are obtained.

TABLE 3a

| No. | Kind of Alloy | Aging Treatment Pattern $T_1$ (°C.) | $t_1$ (min.) | $T_2$ (°C.) | $t_2$ (min.) | No. of Cycles |
|---|---|---|---|---|---|---|
| 1 | 7050 | 120 | 0 | 170 | 0 | 5 |
| 2 | 7050 | 120 | 60 | 170 | 60 | 5 |
| 3 | 7050 | 120 | 60 | 170 | 60 | 2.5 |
| 4 | 7050 | 120 | 0 | 170 | 0 | 1 |
| 5 | 7050 | 120 | 0 | 170 | 0 | 1 |

TABLE 3b

| No. | Heating and Cooling Rates (°C./min.) | 0.2% PS (kgf/mm²) | TS (kgf/mm²) | E λ (%) | Exco Rating | Remarks |
|---|---|---|---|---|---|---|
| 1 | 0.5 | 58.8 | 61.9 | 13.6 | EA | Invention |
| 2 | 0.5 | 54.3 | 56.6 | 15.3 | P | Examples |
| 3 | 0.5 | 59.1 | 62.3 | 13.0 | EA | |
| 4 | 0.5 | 56.4 | 59.7 | 14.5 | ED | Comparison |
| 5 | 0.1 | 58.9 | 62.0 | 13.5 | ED | Examples |

TABLE 4a

| No. | Kind of Alloy | Aging Treatment Condition 1st Cycle $T_1$ | $t_1$ | $T_2$ | $t_2$ | 2nd Cycle $T_1$ | $t_1$ | $T_2$ | $t_2$ |
|---|---|---|---|---|---|---|---|---|---|
| 1 | 7050 | 120 | 0 | 170 | 0 | 120 | 0 | 170 | 0 |
| 2 | 7050 | 120 | 0 | 170 | 0 | 110 | 0 | 190 | 0 |
| 3 | 7050 | 120 | 0 | 170 | 0 | 110 | 0 | 190 | 30 |

TABLE 4b

| No. | Aging Treatment Condition 3rd Cycle $T_1$ | $t_1$ | $T_2$ | $t_2$ | 4th Cycle $T_1$ | $t_1$ | $T_2$ | $t_2$ | 5th Cycle $T_1$ | $t_1$ | $T_2$ | $t_2$ |
|---|---|---|---|---|---|---|---|---|---|---|---|---|
| 1 | 120 | 0 | 170 | 0 | 120 | 0 | 170 | 0 | 120 | 0 | 170 | 0 |
| 2 | 135 | 0 | 160 | 0 | 120 | 0 | 170 | 0 | 130 | 0 | 180 | 0 |
| 3 | 135 | 30 | 160 | 60 | 120 | 60 | 170 | 60 | 120 | 0 | 170 | 0 |

TABLE 4c

| No. | 0.2% PS (kgf/mm²) | TS (kgf/mm²) | E λ (%) | Exco Rating | Remarks |
|---|---|---|---|---|---|
| 1 | 58.8 | 61.9 | 13.6 | EA | Invention Example |
| 2 | 57.1 | 60.8 | 14.5 | EA | Invention Example |
| 3 | 56.6 | 60.1 | 15.5 | P | Invention Example |

What is claimed is:

1. A heat treating method for high strength aluminium alloy comprising the steps of;

(1) solution heat treating an aluminium alloy consisting essentialy of about 3 to 9 wt. % Zn, 1 to 6 wt. % Mg, 1 to 3 wt. % Cu, at least one element selected from the group consisting of 0.1 to 0.5 wt.% Cr, 0.1 to 0.5 wt.% Zr, 0.2 to 1.0 wt.% Mn, and the balance Al, (2) heating the solution heat treated alloy to a temperature of a lower temperature zone of from 100° to 140° C. and optionally maintaining said alloy at a temperature within said lower temperature zone for a duration of time, (3) reheating of the alloy to a temperature of an upper temperature zone of from 160° to 200° C. and optionally maintaining said alloy at a temperature within said upper temperature zone for a second duration of time, (4) cooling of the alloy to a temperature of the lower temperature zone, and (5) repeating the steps (2), (3), and (4) at least twice.

2. The heat treating method for a high strength aluminium alloy of claim 1 wherein said duration of time of the lower temperature zone is null.

3. The heat treating method for a high strength aluminium alloy of claim 1 wherein said duration of time of the upper temperature zone is null.

4. The heat treating method for a high strength aluminium alloy of claim 1 wherein said durations of time of the lower and the upper temperature zones are null.

5. The heat treating method for a high strength aluminium alloy of claim 1 wherein the temperature of the lower temperature zone is from 105° to 125° C.

6. The heat treating method for a high strength aluminium alloy of claim 5 wherein said duration of time of the upper temperature zone is null.

7. The heat treating method for a high strength aluminium alloy of claim 1 wherein the temperature of the upper temperature zone is from 160° to 180° C.

8. The heat treating method for a high strength aluminium alloy of claim 7 wherein said duration of time of the lower temperature zone is null.

9. The heat treating method for a high strength aluminium alloy of claim 1 wherein the temperature of the lower temperature zone is from 105° to 125° C., and the temperature of the upper temperature zone is from 160° to 180° C.

10. The heat treating method for a high strength aluminium alloy of claim 9 wherein said duration of time of the upper temperature zone is null.

11. The heat treating method for a high strength aluminium alloy of claim 9 wherein said durations of time of the lower and the upper temperature zones are null.

12. The heat treating method for a high strength aluminum alloy of claim 1, wherein the solution heat treating is conducted at a temperature of 480° C. and the alloy consists essentially of 5.6 wt. % Zn, 2.3 wt. % Mg, 1.6 wt. % Cu, 0.1 wt. % Cr, 0.2 wt. % Mn and the balance Al.

13. The heat treating method for a high strength aluminum alloy of claim 5, wherein the solution heat treating is conducted at a temperature of 480° C. and the alloy consists essentially of 5.6 wt. % Zn, 2.3 wt. % Mg, 1.6 wt. % Cu, 0.1 wt, % Cr 0.2 wt. % Mn and the balance Al.

14. The heat treating method for a high strength aluminum alloy of claim 7, wherein the solution heat treating is conducted at a temperature of 480° C. and the alloy consists essentially of 5.6 wt. % Zn, 2.3 wt. % Mg, 1.6 wt. % Cu, 0.1 wt. % Cr 0.2 wt. % Mn and the balance Al.

15. The heat treating method for a high strength aluminum alloy of claim 9, wherein the solution heat treating is conducted at a temperature of 480° C. and the alloy consists essentially of 5.6 wt. % Zn, 2.3 wt. % Mg, 1.6 wt. % Cu, 0.1 wt. % Cr 0.2 wt. % Mn and the balance Al.

16. The heat treating method for a high strength aluminum alloy of claim 1, wherein the solution heat treating is conducted at a temperature of 480° C. and the alloy consists essentially of 6.3 wt. % Zn, 2.5 wt. % Mg, 2.5 wt. % Cu, 0.12 wt. % Zr and the balance Al.

17. The heat treating method for a high strength aluminum alloy of claim 5, wherein the solution heat treating is conducted at a temperature of 480° C. and the alloy consists essentially of 6.3 wt. % Zn, 2.5 wt. % Mg, 2.5 wt. % Cu, 0.12 wt. % Zr and the balance Al.

18. The heat treating method for a high strength aluminum alloy of claim 7, wherein the solution heat treating is conducted at a temperature of 480° C. and the alloy consists essentially of 6.3 wt. % Zn, 2.5 wt. % Mg, 2.5 wt. % Cu, 0.12 wt. % Zr and the balance Al.

19. The heat treating method for a high strength aluminum alloy of claim 9, wherein the solution heat treating is conducted at a temperature of 480° C. and the alloy consists essentially of 6.3 wt. % Zn, 2.5 wt. % Mg, 2.5 wt. % Cu, 0.12 wt. % Zr and the balance Al.

* * * * *